United States Patent [19]

Morelli

[11] Patent Number: 4,480,887

[45] Date of Patent: Nov. 6, 1984

[54] ANGLE PLUG CONNECTOR

[75] Inventor: John A. Morelli, Coram, N.Y.

[73] Assignee: Automatic Connector, Inc., Commack, N.Y.

[21] Appl. No.: 388,212

[22] Filed: Jun. 14, 1982

[51] Int. Cl.[3] ..... H01R 13/625

[52] U.S. Cl. ..... 339/94 C; 339/90 C

[58] Field of Search ..... 339/89 R–90 C, 339/177 R, 177 E, 94 C

[56] References Cited

U.S. PATENT DOCUMENTS

| | | | |
|---|---|---|---|
| 2,381,595 | 8/1945 | Hulfish | 339/89 R |
| 3,124,406 | 3/1964 | Cook | 339/89 C |
| 3,480,722 | 11/1969 | Van Horssen et al. | 339/177 E |
| 4,068,911 | 1/1978 | Lodato et al. | 339/90 R |
| 4,239,313 | 12/1980 | Parr | 339/89 C |

*Primary Examiner*—Eugene F. Desmond

*Attorney, Agent, or Firm*—Peter L. Berger

[57] ABSTRACT

A connector end assembly for an angle plug connector used with coaxial cables is disclosed. The assembly includes a one-piece hexagonal body which includes a front portion extending beyond a compression spring which is captured between the bayonet sleeve and body. The projecting portion is deformed against a flat portion to capture the compression spring.

8 Claims, 2 Drawing Figures

ANGLE PLUG CONNECTOR

This invention relates to an improved assembly for the connector end of a coaxial cable connector plug and more particularly for an angled type plug.

The cost of such connector plugs is both labor and material sensitive. Since these items are generally low in cost, economies achieved in the number of parts as well as the ease and time of assembly can be very significant as affecting overall cost, assembly and reliability. Additionally, automating the assembly of such parts and reducing the number of parts is desirable in that there may be fewer quality control problems.

Figure 1:
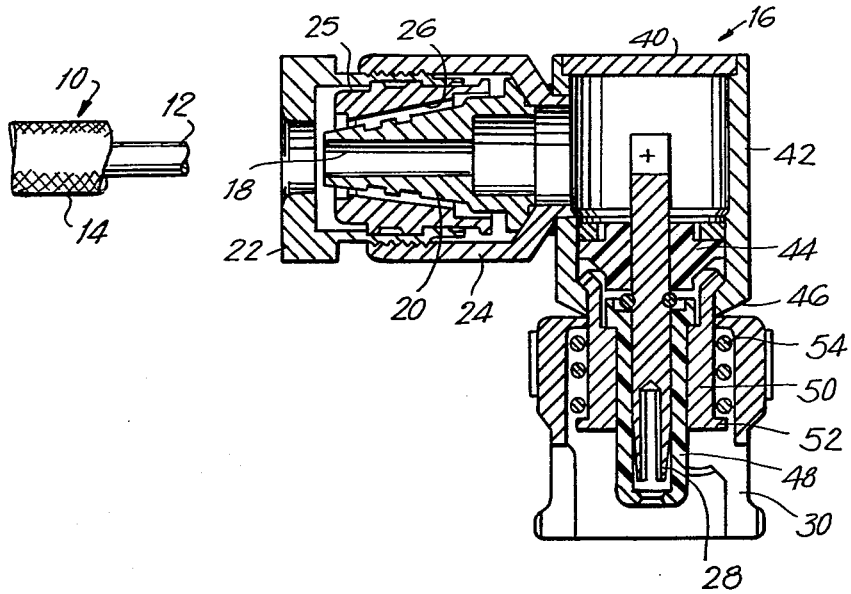
FIG. 1 PRIOR ART
FIG. 1 is a sectional view of the prior art plug.
Figure 2:
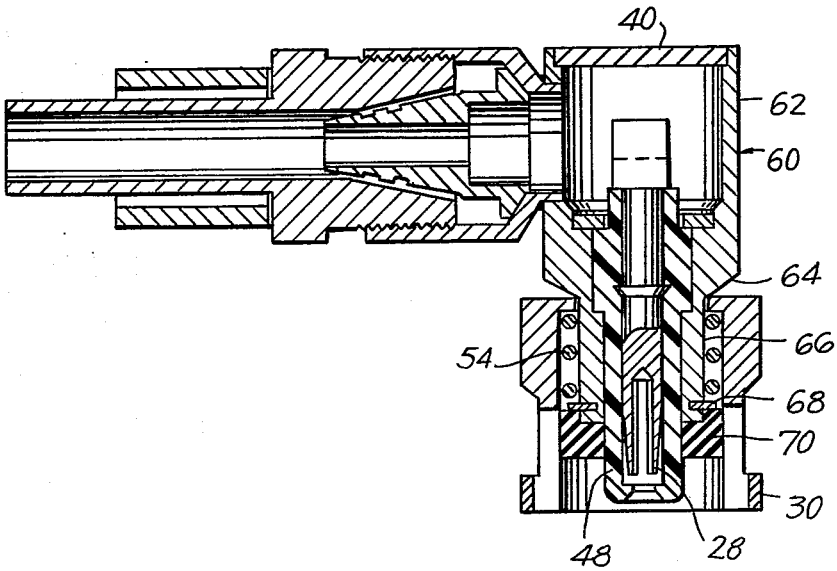
FIG. 2 is a sectional view of the present invention.

FIGS. 1 and 2 each relate to angle connector plugs used with WEDGE-LOCK connectors. Each of these connectors have similar functions, and the same numerals will be used where appropriate.

A coaxial conductor 10 has a center conductor 12 and an outer braided conductor 14. These are to be electrically connected to the angle plug 16 by first inserting the stripped center conductor into a center receptacle 18 formed in the wedge 20, the wedge comprising a tapered rearwardly surface on which the outer braided conductor is fixed as a wedge-nut 22 is screwed into a body 24 which presses a wedge ferrule 25 having inner flared surface 26 which corresponds with that of the wedge to capture the braided conductor. This wedge-nut assembly is common to both angle plugs shown in FIGS. 1 and 2.

The center conductor is electrically connected internally to the bayonet center contact 28 of the two angle plugs as is the outer braid to the bayonet sleeves 30. When the angle plug is connected to its mating receptacle, electrical connection is established between the respective center and outer contacts.

The prior art plug comprises a circular cover 40 fitting over the open end of a hexagonal body 42, the body 42 being in electrical contact with body 24 at the point where the right angle is formed in the angle plug assembly. The hexagonal body holds a generally circular insulator retainer 44, the retainer 44 having a central aperture through which the center contact 28 passes. The body 42 towards the bayonet end terminates in a turn-in tapered end 46 of the body 42.

The angle plug is assembled by placing a fixture (not shown) surrounding an insulator 48 which itself surrounds the center contact. A metallic sleeve 50 is loaded on the fixture around the insulator 48. The metallic sleeve comprises a distal shoulder 52 onto which a compression spring 54 is loaded. The bayonet sleeve 30 has a generally circular configuration with a central aperture which is slightly larger in diameter than the corresponding outer diameters of the parts of the metallic sleeve 50 which are in the vicinity of the central aperture permitting relative rotation thereabout.

Thereafter, hexagonal body 42 is loaded onto the metallic sleeve 52 with the tapered end 46 having an inner diameter slightly greater than the outer diameter of the metallic sleeve. The hexagonal body comes to rest on the back of the bayonet sleeve 30. The upper end of metallic sleeve 52 is formed out against the inside surface of the tapered end 46 to hold the plug end assembly together.

Turning now to FIG. 2, there is shown the present invention. Hexagonal body 60 extends from the cover

40 through the bayonet sleeve to terminate close to the end of the center contact 28. The hexagonal body comprises rearward hexagonal portion 62 which terminates in an inwardly tapered surface 64 which itself terminates in a forward cylindrical section 66. The body is made of a brass. This single piece hexagonal body 60 replaces the separate sleeve 50 and hexagonal body 42. The plug is assembled by turning the plug upside down and loading the hexagonal body 60. Thereafter, the bayonet sleeve 30 is loaded onto the hexagonal body 60 and rests against the outer tapered surface 64 of the body 60. The forward cylindrical section 66 has an outer diameter slightly less than the inner diameter of the aperture of the bayonet sleeve 30. A stainless steel spring 54 is loaded onto the forward portion 66 of the hexagonal body 60.

The inner diameter of the spring 54 is slightly larger than the diameter of section 66 and the outer diameter of the spring is slightly less than the inner diameter of the sleeve 30. The length of section 66 is greater than the length of the spring 54 when compressed so that a portion of the front section projects beyond the spring.

A stop or washer 68 is loaded onto the end of the spring 54. Thereafter, the portion of the front section 66 of the body which extends beyond the spring is deformed or swaged outwardly to capture the washer and compression spring 54 so that the spring is retained between the body 60 and sleeve 30. A gasket 70 is then loaded onto the insulator 48. As can be seen, the present invention reduces the number of components, eases the assembly and facilitates automated assembly.

Although this invention has been described with reference to an angle plug, the assembly is also equally useful with straight plug connectors. Additionally, the body although shown to be hexagonal needs not be so limited.

This invention has been described with an illustrative embodiment but other embodiments will be readily apparent to those of skill in the art without departing from the teachings of this invention.

What is claimed is:

1. In a plug type bayonet connector, an assembly for the connector end of said plug connector, said assembly comprising a one-piece body comprising an outer cylindrical segment terminating in an inwardly tapered wall segment which terminates in a cylindrical front end of said body, a sleeve adapted to serve as the end covering of said plug connector, said sleeve being loaded onto said body, a spring having an inner diameter slightly greater than the outer diameter of said cylindrical front end and having a length which is less than the length of said cylindrical front end when said spring is compressed, said spring being loaded onto said cylindrical front end and having an outer diameter slightly less than that of the inner diameter of said sleeve, a washer loaded onto the spring compressing the spring such that the end of said cylindrical front end projects beyond said washer, said projecting front end projecting beyond said washer and being deformable, said projecting front end being deformed about said washer to capture said spring between said body and said sleeve.

2. An assembly as claimed in claim 1, further comprising a gasket loaded onto the connector end to seal said connector end.

3. An assembly as claimed in claims 1 or 2, wherein said means for deforming comprises swage means applied against the distal end of said body.

4. An assembly as claimed in claim 3, wherein said washer comprises a flat washer.

5. An assembly as claimed in claims 1 or 4, wherein said body is hexagonal and comprises brass.

6. An assembly as claimed in claim 4, wherein said hexagonal body and said washer comprises brass.

7. An assembly as claimed in claim 1, wherein said body is hexagonal.

8. An assembly as claimed in claim 1, wherein plug-type connector comprises an angle plug type connector.

* * * * *